US005946736A

United States Patent [19]

Caspescha et al.

[11] Patent Number: 5,946,736

[45] Date of Patent: Sep. 7, 1999

[54] FLAVORED GOGGLES STRAPS

[76] Inventors: George L. Caspescha, 18 Weston Dr., Mohnton, Pa. 19540; Dean J. Exas, 2 Steevers Ct., Reading, Pa. 19607

[21] Appl. No.: 08/873,318

[22] Filed: Jun. 11, 1997

[51] Int. Cl.[6] ..... A61F 9/02

[52] U.S. Cl. ..... 2/428; 2/452; 426/104

[58] Field of Search ..... 2/426, 428, 430, 2/452, 163, 167, 169; 426/104; 433/142

[56] References Cited

U.S. PATENT DOCUMENTS 3,902,509 9/1975 Tundermann et al. ..... 433/142

3,942,193 3/1976 Pugh ..... 2/167

5,138,719 8/1992 Orlianges et al. ..... 2/169 X 5,564,132 10/1996 Kuo ..... 2/430

5,596,771 1/1997 Hsu et al. ..... 2/428

*Primary Examiner*—Peter Nerbun

*Attorney, Agent, or Firm*—Goldstein & Canino

[57] ABSTRACT

Flavored goggles, having lenses and a strap for attaching the goggles around a swimmer's head. The goggles straps have a flavored coating which is selectively released when the strap is placed within the swimmer's mouth. The flavored coating provides a pleasant flavor to the strap.

1 Claim, 2 Drawing Sheets

FLAVORED GOGGLES STRAPS

BACKGROUND OF THE INVENTION

The invention relates to flavored goggles straps. More particularly, the invention relates to swimming goggles in which the head band has a flavored coating.

Goggles are commonly used in a variety of occupations and activities in which eye protection is needed. Swim goggles in particular are used by swimmers to allow vision underwater, where optical characteristics do not allow the eyes to properly focus. The goggles provide a thin pocket of air in front of the eye, which allows the eyes to focus.

When out of the water and around the pool, must swimmers don't quite know what to do with their goggles. Some swimmers put the goggles on the top of their head, others let them dangle around their neck, but the greater majority of swimmers hold them in their mouth, with the strap dangling from their teeth.

The problem with holding the goggle strap in one's mouth is the poor taste. The strap is traditionally made of rubber or latex, which is far from tasty.

SUMMARY OF THE INVENTION

It is an object of the invention to produce a swim goggles strap or headband which eliminates problems inherent in prior art swim goggle straps and headbands.

It is another object of the invention to produce a swim goggles strap or headband which may be held in one's mouth in between use, without an unpleasant taste.

It is a further object of the invention that the swim goggles strap has a flavored coating which provides a pleasant taste to the swimmer.

It is a still further object of the invention that the flavored coating is triggered by saliva and/or chewing, to avoid being dissolved by swimming pool water.

The invention is flavored goggles straps for attaching goggles around a swimmer's head. The goggles straps have a flavored coating which is selectively released when the strap is placed within the swimmer's mouth. The flavored coating provides a pleasant flavor to the strap.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
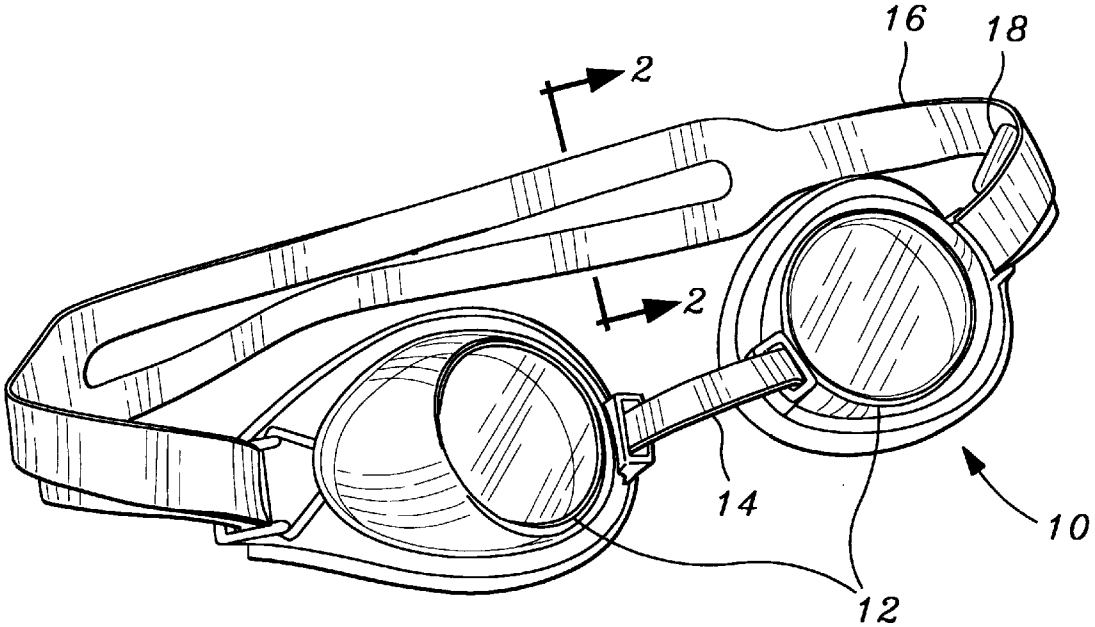
FIG. 1 is a diagrammatic perspective view, illustrating a pair of swimming goggles according to the present invention.

FIG. 1 illustrates a pair of swimming goggles 10 having a pair of lenses 12 and a bridge 14 between the lenses 12. The goggles 10 have a head strap 16, which extends between the lenses 12 on an opposite side from the bridge 14. The strap 16 has an adjustment mechanism 18 for adjusting the length of the strap 16 to accommodate different head sizes.

Figure 2:
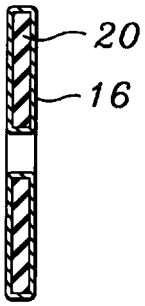
FIG. 2 is a cross sectional view, taken along line 2—2 in FIG. 1.

FIG. 2 is a cross sectional view taken along line 2—2 in FIG. 1. The strap 16 is made of rubber, latex, or a synthetic rubber like material, which has a coating 20 according to the present invention. The coating 20 contains a flavoring, which thus provides a flavoring to the strap.

The coating 20 may be any flavoring substance which provides a pleasant flavor to the strap 16. The flavoring substance should be selected so that it does not dissolve easily in the pool water, but releases upon contact with saliva, or by physical abrasion when contacted by the swimmer's teeth.

Figure 3:
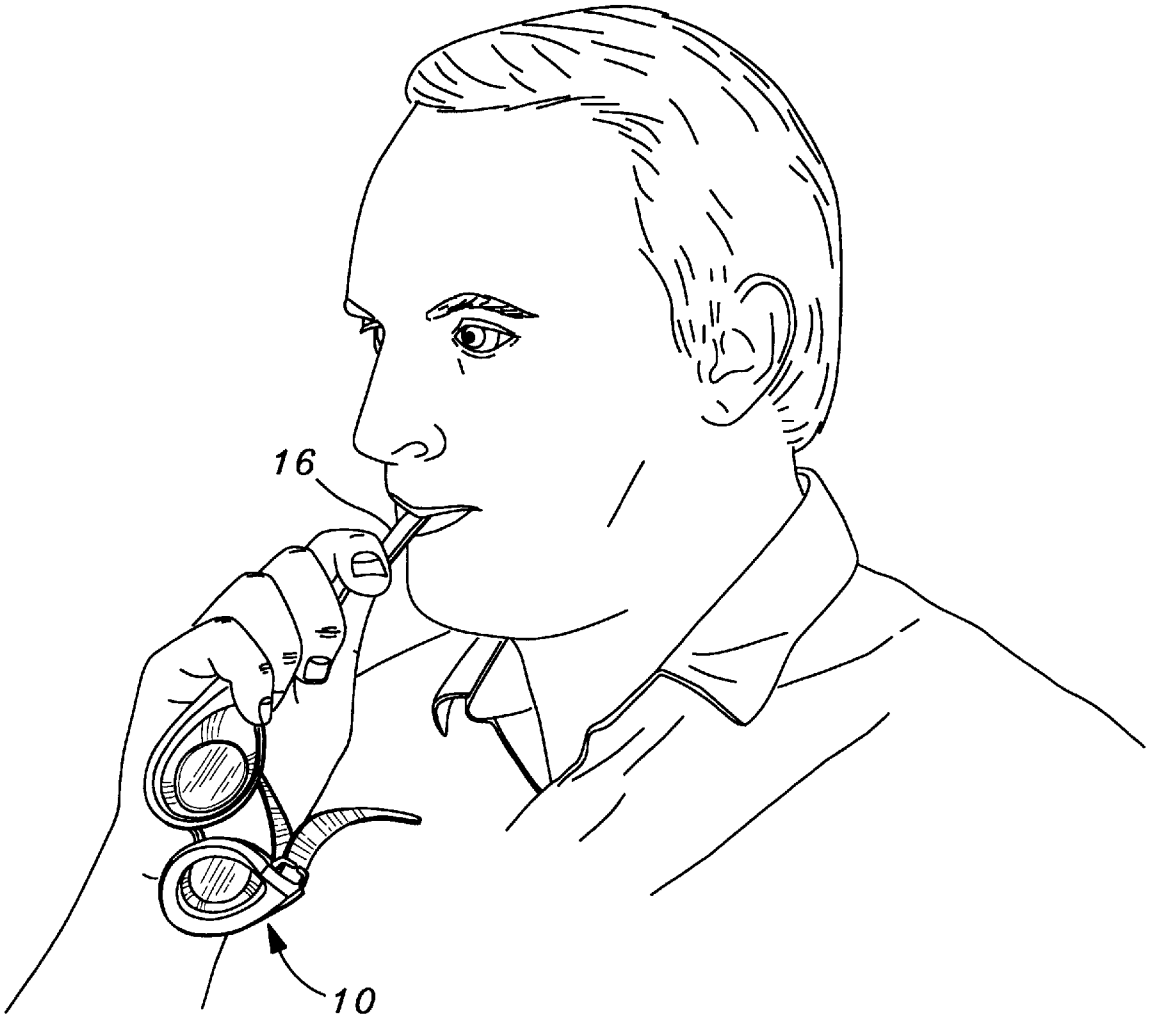
FIG. 3 is a front view of the goggles in use.

FIG. 3 illustrates the swim goggles 10 in use, with the head strap 16 suspended from a swimmer's mouth.

Figure 4:
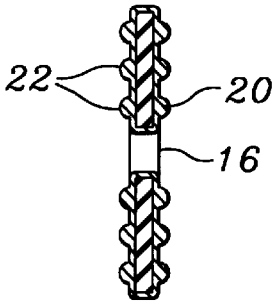
FIG. 4 is a cross sectional view of a further embodiment of the goggles.

FIG. 4 illustrates a further embodiment of the goggles 10, wherein the strap 16 has microscopic bubbles 22. The flavored coating 20 is contained within the microscopic bubbles 22. Thus, the flavored coating 20 is protected from dissolving when the goggles 10 are submerged. However, when the goggles straps 10 are placed in the mouth, some of the microscopic bubbles 22 are broken by abrasion. Once broken, the coating 20 is released from the microscopic bubbles 22 to provide a pleasant flavoring to the swimmer.

What is claimed is:

1. A goggle, having lenses and a strap, comprising:

a flavored coating, said coating on the strap for providing a pleasant flavoring to a swimmer when the strap is placed in the swimmer's mouth; and microscopic bubbles positioned along the strap, partially containing the flavoring.

* * * * *